US005136870A

United States Patent [19]

Gartner et al.

[11] Patent Number: 5,136,870

[45] Date of Patent: * Aug. 11, 1992

[54] DUAL ELECTRONIC LOCK FOR HUMAN PASSAGE DOOR

[75] Inventors: Klaus W. Gartner, Palos Verdes, Calif.; Alan K. Uyeda, 8317 Elsmore Dr., Rosemed, Calif. 91770

[73] Assignee: Alan K. Uyeda, Pico Rivera, Calif.

[ * ] Notice: The portion of the term of this patent subsequent to Feb. 13, 2007 has been disclaimed.

[21] Appl. No.: 478,698

[22] Filed: Feb. 12, 1990

Related U.S. Application Data

[63] Continuation-in-part of Ser. No. 193,520, May 11, 1988, Pat. No. 4,899,562.

[51] Int. Cl.[5] ..... E05B 47/00

[52] U.S. Cl. ..... 70/277; 70/311; 70/278

[58] Field of Search ..... 70/133, 277, 278, 279, 70/311, 149, 332, 107

[56] References Cited

U.S. PATENT DOCUMENTS 1,353,257 9/1920 Mample .
2,079,702 5/1937 Diesel .
2,775,114 12/1956 Lee .
3,045,466 7/1962 Herlong .
3,339,382 9/1967 Miller et al. .
3,376,721 4/1968 Levine .
3,559,430 2/1971 Waller .
3,702,070 11/1972 Gartner .
3,758,734 9/1973 Gartner .
3,968,667 7/1976 Gartner et al. .
3,980,844 9/1976 Bianco .
4,038,846 8/1977 Klann .
4,106,316 8/1978 Tippin .
4,148,092 4/1979 Martin .
4,328,689 5/1982 Keller et al. .
4,457,148 7/1984 Johansson et al. .
4,745,784 5/1988 Gartner .
4,899,562 2/1990 Gartner ..... 70/277

FOREIGN PATENT DOCUMENTS 1215291 10/1966 United Kingdom .

*Primary Examiner*—Robert L. Wolfe
*Attorney, Agent, or Firm*—Poms, Smith, Lande & Rose

[57] ABSTRACT

An electronic door lock is provided with a single control knob used for entering a predetermined combination through manipulation of the knob in a first arc of rotation, the code being entered by pushing the dial inwardly to bring a push pad into contact with individual ones of an arcuate array of electrical switches provided on a printed circuit board within the lock dead housing, the release of the door locking bolt being accomplished after entry of the predetermined code by further manipulation of the control knob through remaining portions of knob rotation which are unavailable until after entry of the predetermined code. A digitally operated code input pad assembly is also provided to enter such code and a second code to open a second lock mechanism associated with the door spring bolt giving two levels of security for the human passage door.

12 Claims, 3 Drawing Sheets

60
61
62
63
65
71
72
73
74
75
76
77
78
80
81
82
83
84
85
86
90
92
93
94
95
12
13
15
100
101
102
103

2
2
10
11
12
13
14
15
17
19
22
60

DUAL ELECTRONIC LOCK FOR HUMAN PASSAGE DOOR

RELATED APPLICATIONS:

This application is a continuation-in-part of application Ser. No. 07/193,520, filed May 11, 1988 entitled "ELECTRONIC DOOR LOCK", now U.S. Pat. No. 4,899,562.

BACKGROUND OF THE INVENTION

The present invention relates in general to electronically operated door locks and more specifically to electrical door locks wherein a door opening code is entered through the use of a rotatable and axially moveable control knob and/or digital input pads for entering a predetermined code to a printed circuit board within the lock housing. More specifically, the present invention relates to such locks which are adaptable for replacement of ordinary dead bolt lock mechanisms in association with continued use of the door handle and spring bolt of an otherwise standard door.

Electronic door locks have been developed heretofore which provide for the manipulation of a control knob through two degrees of movement, rotation and axial translation, to select and enter individual ones of a predetermined sequence of a numerical or other bases code in association with a printed circuit board provided within the lock housing. Exemplary thereof is the electronic dial combination lock of U.S. Pat. No. 4,745,784 issued to Klaus W. Gartner, the disclosure of which is incorporated herein by this reference. In that lock, dialing of the control knob for selection of a numerical code indicia on the dial face is translated into an electrical contact made on the circuit board within the lock housing by pushing the control knob inwardly of the lock. The circuit board has appropriate circuitry for generation of an electrical signal to an associated solenoid which controls movement of a locking lever which prevents opening of the lock until the combination was entered. The dial is rotated through a full 360' of rotation allowed during entry of the code and is thereafter employed for opening the lock after the predetermined code has been entered. That lock is particularly suitable for replacing a standard gated tumbler wheel type mechanical combination lock with an electrical combination lock as more fully described in said application. This application is a continuation-in-part of application Ser. No. 07/193,520 filed May 11, 1988 entitled "ELECTRONIC DOOR LOCK", now U.S. Pat. No. 4,899,562, the complete disclosure of which is incorporated here by this reference.

SUMMARY OF THE INVENTION

It would be desirable to be able to modify a standard dead bolt lock mechanism of a typical residential and/or commercial entry door with an electronic lock which would give increase security to such a door. It would also be desirable to be able to continue to use the preexisting dead bolt and the door opening handle normally provided on such doors in association with the standard spring bolt latch normally employed.

It would also be desirable to be able to modify the standard dead bolt lock and spring bolt latch mechanisms of a typical commercial entry door with electronic locks which would give two levels of security to such a door. It would also be desirable to be able to continue to use the preexisting dead bolt and the door opening handle normally provided on such doors.

It is therefore a primary object of the present invention to provide electronic locks for a commercial door wherein the first lock mechanism is easily assembled to such a door in place of the manipulative portions of the existing dead bolt mechanism, and the second lock mechanism is easily assembled in place of the existing spring biased bolt latch mechanism. It is also an object of the present invention to provide an electronic lock wherein a single control knob may be employed for entry of the first lock combination as well as for moving the dead bolt between protracted and retracted positions, and a digital keypad may be employed for entry of the second combination. It is a further object of the present invention to provide a first lock as in the foregoing objects wherein the movement of the control knob is limited during the first code entry mode to a limited amount of rotation wherein it is not capable of moving the dead bolt until after the first code has been entered, the knob being then freed to be manipulated by the user to throw the bolt between the door locking protracted and door release retracted positions. It is still further object of the present invention to provide a second lock as in the foregoing objects wherein the movement of the door handle is restricted wherein it is not capable of moving the spring biased bolt latch until after the second code has been entered, the handle then being freed to be manipulated by the user to throw the spring biased bolt between the protracted and retracted positions. It is still further object of the present invention to provide a first electronic lock for night time security and a second electronic lock for day time security.

Generally stated, the present invention includes a first electronic door lock having a dial and push code entry and door bolt control knob for receiving a first predetermined coded sequence and a printed circuit board to thereafter generate a first code responsive electrical signal, a dial shaft associated disc being thereby mounted for both rotational and axial movement in response to similar movement of the control knob, limiting means for normally limiting the arc of rotation of the knob shaft, electrically operated means associated with the printed circuit board for deactivating the limit means on receipt of the code responsive electrical signal and door bolt mounting means for connecting the knob to the door bolt for shifting the latter when the knob limiting means has been released through entry of the first predetermined code. Additionally, the present invention includes a second electronic door lock having a digital keypad for entry of a second predetermined coded sequence and a circuit board for thereafter generating a second code responsive signal, a door handle and associated lever control means for retracting the spring biased bolt latch in response to manipulation of the door handle, a locking means for normally restricting movement of the lever control means, and a second electrically operated means associated with the circuit board for releasing the locking means in response to the second code responsive electrical signal.

More specifically, the printed circuit board of the present invention is provided with a plurality of electrical contact switches disposed in a semi-circular array of 180 degrees arc or less for receiving the first predetermined coded sequence of switch actuations. More specifically, the limiting means includes the provision of a pair of limit stops on the periphery of a limit disc and the post portion of the armature of a first electrically operated solenoid, the post normally positioned to engage the limit stops to thereby limit rotation of the knob shaft, the limit disc having retainer lips associated with the limit stops and the post having a retainer flange which engages the retainer lips. More specifically, the lever control means is provided with an actuating disc having a finger to manipulate the spring bolt against its spring bias to the retracted position, and a control key which is normally captured by a locking means to prevent movement of the actuating disc until after receipt of the second code responsive signal. More specifically, the locking means is provided with a pivoting locking plate normally positioned to engage and capture the control key, and which pivots into the release position upon actuation of a solenoid controlled by the printed circuit board.

In addition to the foregoing, the electronic lock of the present invention is adapted to mate with and utilize an existing door dead bolt and spring biased latch bolt mechanism by being mountable to the front surface of such a door with the extension entering the door through the preexisting dead bolt actuating knob mounting aperture and door latch operating lock tailpiece.

A more complete understanding of the electronic door locks of the present invention will be afforded to those skilled in the art, as well as a realization of additional advantages and objects thereof, by a consideration of the following detailed description of a preferred exemplary embodiment thereof. Reference will be made to the appended sheets of drawings which will be first described briefly.

DETAILED DESCRIPTION OF A PREFERRED EXEMPLARY EMBODIMENT

Figure 1:
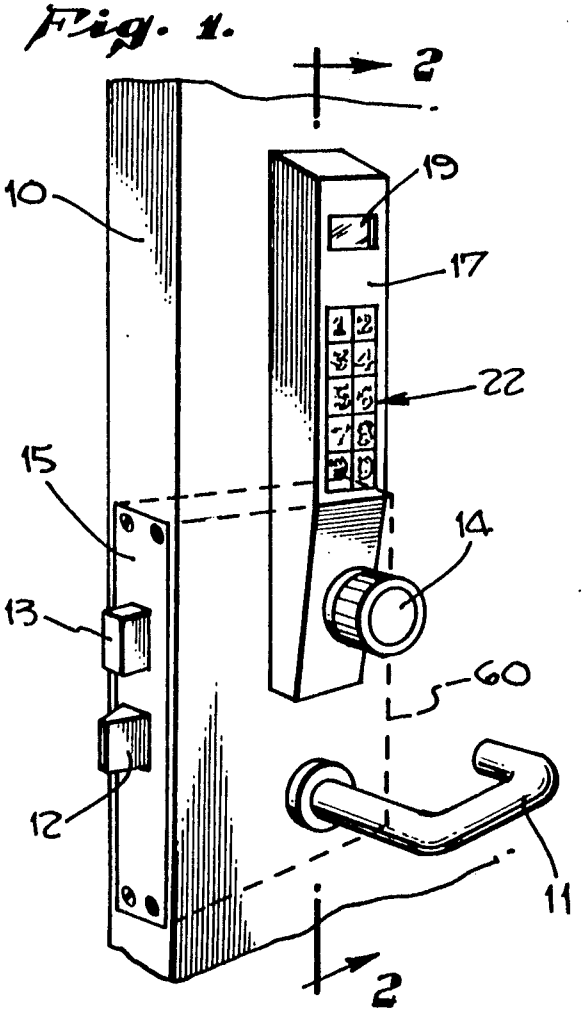
FIG. 1 is a perspective view of an exemplary metal door installation of a preferred exemplary embodiment of the electronic door lock of the present invention.

Referring now to FIG. 1, a preferred exemplary embodiment of a dual electronic door lock in accordance with the present invention is illustrated in association with a metal door 10 having an otherwise standard door handle 11 which operates a spring bolt 12. Dead bolt 13 is, in accordance with the present invention, controlled by rotation of the control knob 14 which is also used for entering the electronic code as will be described hereinafter. A standard face plate 15 closes the door cavity within which the spring bolt 12 and dead bolt 13 operate as hereinafter described. A standard door jamb plate 101 closes a cavity within the door jamb 100, and is affixed thereto forming first bolt receptacle 103 for insertion of dead bolt 13 and second bolt receptacle 102 for insertion of spring bolt 12.

Figure 2:
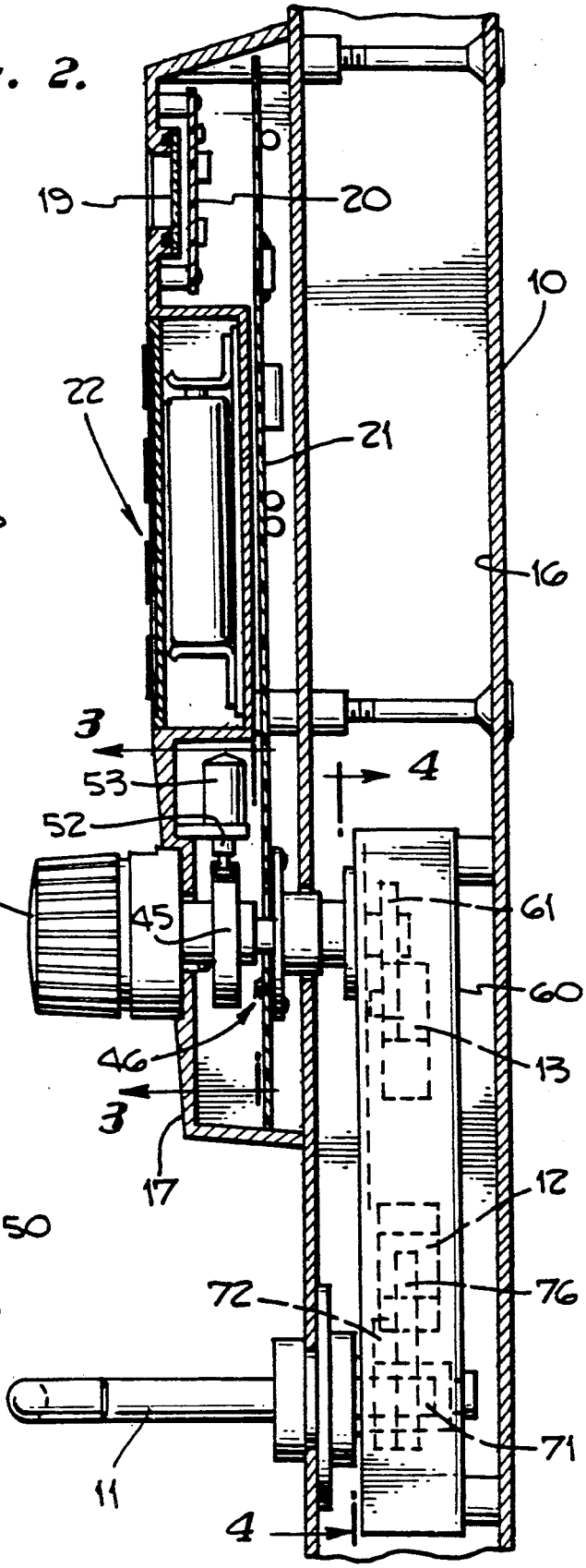
FIG. 2 is a section view of the lock of FIG. 1 taken therein along the plane II—II.

As seen in FIG. 2, the electronic door lock components are provided partially within a rear housing 16 formed within metal door 10, and partially within a face plate 17 which forms a front housing with door 10. Face plate 17, as seen in FIGS. 1 and 2, is provided with a transparent window 19 in front of a liquid crystal display 20 which is electrically connected to a printed circuit board 21 such that code numbers selected, through manipulation of control knob 14 as hereinafter described, will be displayed on the liquid crystal display 20. A secondary manner of entering the code for the first electronic lock of the present invention, and the only manner of entering the code for the second electronic lock, is provided through the digital input keypad illustrated generally at 22 on the front face of face plate 17 as seen in FIGS. 1 and 2.

The control knob 14 of the first electronic door lock of the present invention is normally biased in an outward direction by internal spring means. An inward manipulation of knob 14 brings a push pad 44 mounted eccentrically upon disc 45 into engagement with one of the printed circuit board switches, such as the switch indicated generally at 46 in FIG. 2. Disc 45 is adapted to rotate via manipulation of knob 14 in a rotative direction. As is particularly contemplated within the present invention, switch 46 is one of a plurality of such switches arranged in an approximate 180 degree orbital array. Each of the thus provided switches, such as the switch indicated at 46, complete an electrical circuit provided in a known manner on the printed circuit board 21. Board 21 includes circuit means for sensing the making of the electrical connections by the switches and detecting when a given subset of connections has been made in a predetermined, sequential order corresponding to a code or combination for the lock. The circuit board 21 also has means for generating a first electrical signal, such as a voltage, to operate a first lock release means as discussed hereinafter.

As is particularly contemplated within the present invention, the signal generated by the printed circuit board 21 is utilized in the first electronic lock for operating a knob rotation limiting means to a release position so that the knob 14 can be employed for opening the lock in addition to the entry of the predetermined code. As explained hereinabove, the knob 14 has a push pad 44 which is oriented by rotation of the knob to select any one of the plurality of switches on the circuit board 21 which are arranged in a 180 degree arcuate array. Rotation of the knob through the second 180 degree of arcuate rotation for the knob throws the bolt 13 to the retracted position. However, limiting means are provided for preventing rotation of the knob 14 through this second 180 degrees of rotation until after the predetermined code has been entered through rotation of the knob in the first 180 degrees of rotation relative the circuit board switches.

Figure 3:
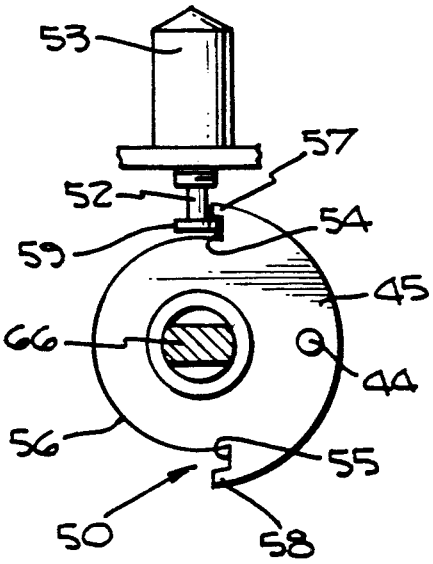
FIG. 3 is a detail view of the lock of FIG. 2 taken in the plane of III—III, showing the limiting means in the normal condition.
Figure 5:
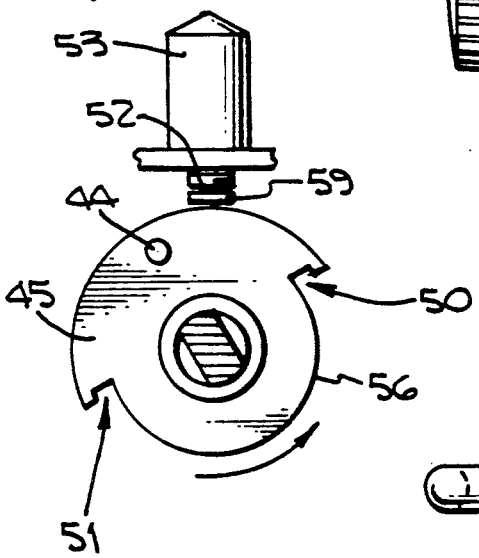
FIG. 5 is a view as in FIG. 3 showing the control knob limiting means in a knob release condition.

In the preferred exemplary embodiment, the limiting means for limiting code entering rotation of knob 14 to a first 180 degrees arc of rotation includes the provision of a pair of limit stops, indicated generally at 50 and 51 respectively, as seen in FIGS. 3 and 5. Such limit stops are formed integrally of the disc 45. In addition, the exemplary limiting means includes the provision of post 52, which in the exemplary embodiment comprises a portion of the armature of a first electrically operable solenoid 53, the post 52 being normally positioned as seen in FIG. 3 to be abutted by the limit stops, indicated generally at 50 and 51, to limit rotation of the knob 14 to a first 180 degrees arc of rotation. The push pad 44 as seen in FIGS. 3 and 5 is also provided with a maximum 180 degrees arc of rotation which corresponds to the arc of the array of switches, such as switch 46, provided on the circuit board 21. First solenoid 53 is electrically connected to printed circuit board 21 in otherwise known manner so as to receive the electrical signal, such as voltage, generated by the circuit board 21 when a predetermined, sequential order of switch contacts are made by the manipulation of knob 14 and its associated push pad 44 to enter a predetermined code. As is also known in the art, the circuit board 21 may include a timing means for holding the solenoid 53 in an electrically operable mode for a period of time so that manipulation of the lock can be accomplished while the solenoid is activated.

In the exemplary embodiment, when first solenoid 53 is electrically operated through entry of a first predetermined code as discussed above, the post 52 is withdrawn inwardly of the solenoid as shown in FIG. 5. Disc 45 is thereby released from its limited rotation and manipulation of knob 14 through the remaining 180 degrees of arcuate rotation available, as described hereinafter, throws bolt 13 to a retracted position.

The preferred exemplary embodiment limit stops, indicated generally at 50 and 51 in accordance with the present invention, comprise more specifically the provision of a pair of stop surfaces 54 and 55 respectively, as seen in FIG. 3, at the opposite ends of peripheral surface 56 on disc 45. Importantly, the stop surfaces 54 and 55 are provided with over-hanging retainer lips 57 and 58 which cooperate with the retainer flange 59 to retain post 52 in its knob rotation limiting position of FIG. 3, the flange 59 underlying the associated retainer lip of the stop surfaces when the knob is turned to the limits of the 180 degrees arc of rotation provided. The provision of the retainer lips described is important to prevent unauthorized rotation of knob 14 in the bolt unlocking mode as might otherwise occur if the post 52 could be urged inwardly of solenoid 53, against the outward bias of an internal spring provided, through vibration, tapping or other unauthorized manipulation of the lock mechanism when the post 52 is adjacent either of the stop surfaces. The provision of the retainer flange on post 52 and retainer lips 57 and 58 hold post 52 in engagement with the limit stops 50 and 51 in a secure non-defeatable manner when the knob 14 has been rotated to either extremes of its limited arc of rotation.

Figure 7:
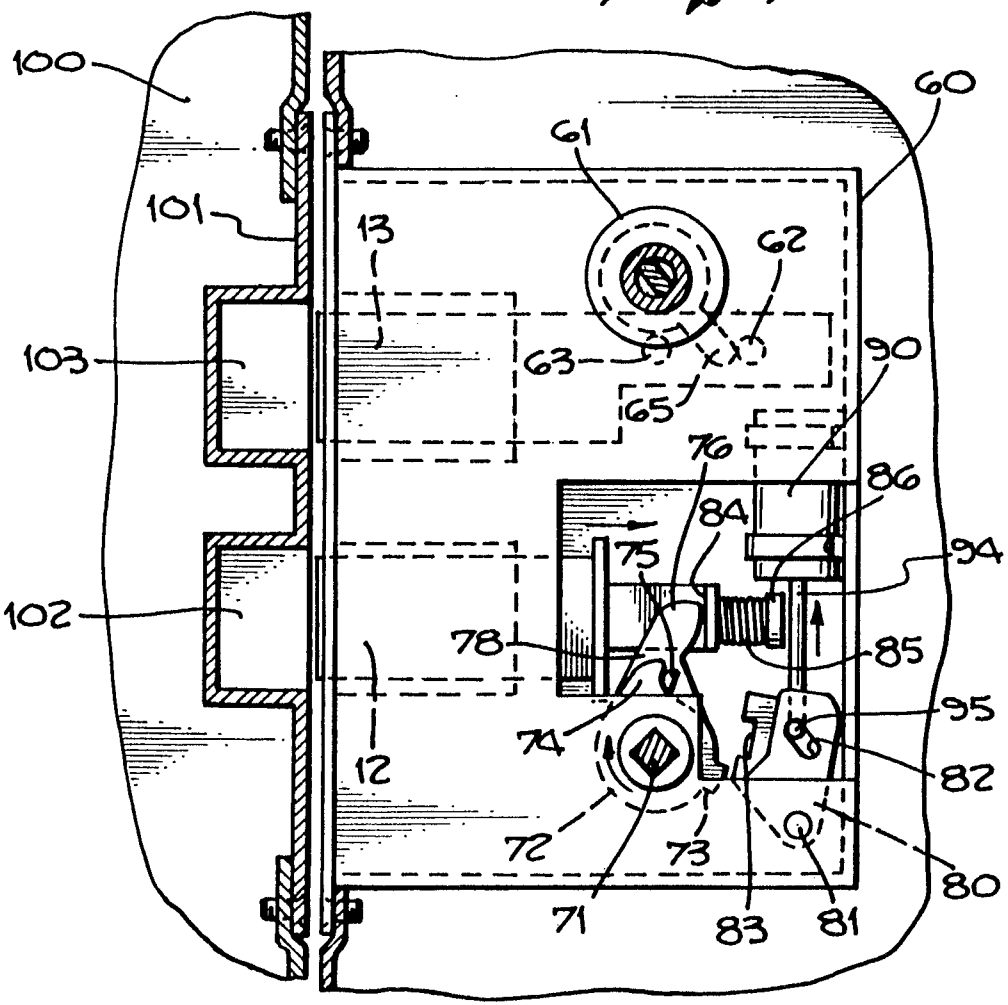
FIG. 7 is a view as in FIG. 4 showing the lever control means released by the locking means and retracting the spring biased bolt.

Considering now the manner of manipulation of bolt 13 through operation of control knob 14 and referring initially to FIG. 2, the bolt 13 is provided in known manner in a bolt housing 60 within the surrounding housing 16 provided by door 10. As will be subsequently explained, bolt 13 is moved from its door locking extended position of FIG. 4 to a retracted door release position as shown in FIG. 7 through the manipulation of tail piece 61 relative to a pair of spaced pins 62 and 63 protruding laterally of a sidewall of bolt 13 within the bolt housing 60. A flat sided axial extension member 66 formed integrally of disc 45 is slip fit into tailpiece 61 to facilitate rotation of tailpiece 61 in direct response to rotation of control knob 14, such that rotation of knob 14 in a counterclockwise direction through the second 180 degree arc of rotation produces a clockwise rotation of tailpiece 61 when viewed in FIG. 7 bringing the tailpiece tip 65 into engagement with rear pin 62 to throw bolt 13 to a retracted position. Subsequently, when knob 14 is rotated in a clockwise direction producing a counterclockwise rotation of tailpiece 61 when viewed in FIG. 4, the tailpiece tip 65 engages the forward pin 63 to throw the bolt back to the protruding door locking position.

Figure 4:
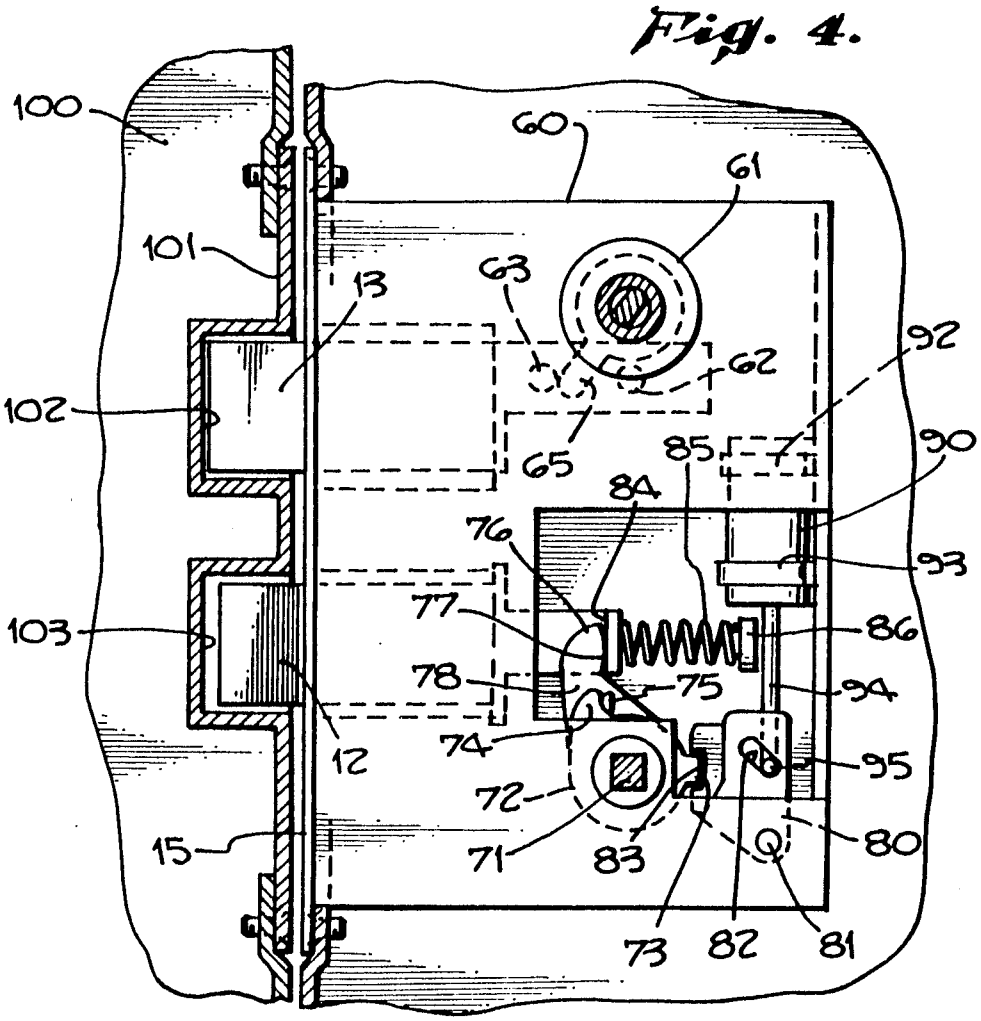
FIG. 4 is a detail view of the lock of FIG. 2 taken in the plane of IV—IV, showing the first and second electronic locks with bolts in the protracted position.

Referring now to FIG. 4, the spring bolt 12 of the second electronic door lock of the present invention is provided in known manner in a bolt housing 60 within the surrounding housing 16 provided by door 10. The exemplary spring bolt 12 is normally biased in the protracted position by spring 85 which compresses against spring compression retainer 86. Spring bolt 12 is moveable to the retracted position against its bias by manipulation of the door handle 11 in cooperation with the hereinafter described lever control means. Door handle 11 connects to a rectangular shaft 71 which penetrates the front surface of door 10 and enters bolt housing 60 within the surrounding housing 16.

In the preferred exemplary embodiment, a lever control means for retracting spring bolt 12 is provided and comprises an actuating disc 78 and a control disc 72. Integral to actuating disc 78 is an actuating finger 76 which has a contact surface 77 which cooperates linearly with biasing tab 84 integral to spring bolt 12 to retract spring bolt 12 against its bias. Actuating disc 78 is mounted axially on shaft 71 and rotates independently of shaft rotation. Control disc 72 has a second actuating finger 74 which cooperates radially with actuating post 75, perpendicularly mounted on the surface of actuating disc 78. Control disc 72 is also axially mounted on shaft 71, however its rotation is dependant on shaft rotation and door handle 11 manipulation. Control disc 72 and actuating disc 78 operate together to form a connection between door handle 11 and spring bolt 12, such that manipulation of door handle 11 will retract spring bolt 12 against its bias. In the preferred exemplary embodiment, control disc 72 has an integral control key 73 which is normally captured by a hereinafter described locking means which prevents movement of the door handle and associated lever control means. The exemplary locking means includes the provision of a locking plate 80 which pivots radially about pivot point 81. Integral to locking plate 80 are control aperture 83 and diagonal pivot guide channel 82. Normally, locking plate 80 is positioned such that control key 73 mates with and is captured by control aperture 83. Pivot position of locking plate 80 is determined by a second electrical means, which releases the lever control means from capture by the locking means. Second electrical means consists of second solenoid 90, held in position within housing 60 by restraining straps 92 and 93, associated solenoid linkage 94 and pin 95. Pin 95 travels freely within pivot guide channel 82, such that activation of second solenoid 90 retracting linkage 94 causes pin 95 to travel from an extreme end of pivot guide channel 82 to the other end causing locking plate 80 to pivot clockwise about pivot point 81, further causing release of control key 73 from capture within control aperture 83.

Figure 6:
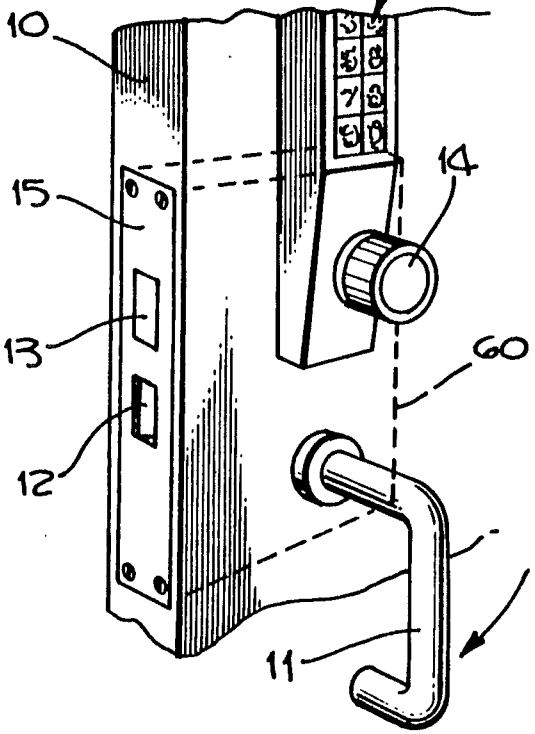
FIG. 6 is a view as in FIG. 1 showing the door handle manipulated to retract the spring biased bolt.

As is particularly contemplated within the present invention, entry of the second predetermined code by use of the digital input keypad, indicated generally at 22, causes the circuit board 21 to generate a second electrical signal, or voltage, which is transferred by otherwise known manner to second solenoid 90 of second electrical means described hereinabove. As is also known in the art, circuit board 21 may include a timing means for holding the solenoid 90 in an electrically operable mode for a period of time so that manipulation of the lock can be accomplished while the solenoid is activated. Upon activation of the solenoid 90, the linkage 94 retracts causing locking plate 80 to pivot further causing control key 73 to be released from capture within control aperture 83. The user is then enabled to manipulate door handle 11, causing actuating finger 76 to retract spring bolt 12 against its bias, unlocking door 10, as shown in FIGS. 6 and 7.

As is also particularly contemplated within the present invention, the spring bolt 12 is provided with a cam end surface 18, as shown in FIG. 1. Upon closure of door 10, cam end surface 18 contacts jamb plate 101, retracting spring bolt 12 against its bias until door 10 is fully closed, whereupon spring bolt 12 returns to its normally biased position within receptacle 102.

In a preferred exemplary embodiment of the present invention, bolt 13 of the first electronic lock is a deadbolt which is kept in the protracted or locked position during extended closure periods such as at night, but remains unlocked during frequent use periods such as during the day. Additionally, spring bolt 12 of the second electronic lock is a cam end bolt as hereinabove described, which would remain in use at all times, providing day time security. Accordingly, the present invention always provides a minimum of one level of security, and two levels of security are provided during extended closure periods.

Having thus described a preferred exemplary embodiment of the present invention, it should be appreciated by those skilled in the art that various modifications, adaptations and alternative embodiments therein may be made within the scope and spirit of the present invention which is defined by the following claims.

We claim:

1. An electronic door lock having a first code entry door bolt mechanism and a second code entry door bolt mechanism and an associated circuit board means for receiving a first coded sequence and producing a first code responsive electrical signal and for receiving a second coded sequence and producing a second code responsive signal, said first code entry door bolt mechanism comprising:

a first door bolt and means for mounting said first door bolt for movement between protracted and retracted positions relative said door;

a manually rotatable and axially moveable knob means for manually entering said first coded sequence by rotative and axial movement thereof and for thereafter shifting said first door bolt between retracted and protracted positions by rotation through a given arc of rotation;

limit means for normally limiting said knob means from rotating through said given arc of rotation and thereby normally restricting operation of said first door bolt;

first electrically operated means associated with said circuit board means for deactivating said limit means on receipt of said first code responsive electrical signal to thereby release said knob means for manipulation of said first door bolt to retracted position;

said second code entry door bolt mechanism comprising:

a second door bolt and means for mounting said second door bolt for movement between protracted and retracted positions relative said door, and a biasing spring associated with said second door bolt for maintaining protracting pressure on said second door bolt;

a door handle and an associated lever control means for retracting said second door bolt in response to manipulation of said door handle;

locking means for normally restricting movement of said lever control means;

second electrically operated means associated with said circuit board for releasing the said locking means in response to said second code responsive electrical signal from said circuit board to thereby release said lever control means and associated door handle for manipulation thereof to retract said second door bolt.

2. The electronic door lock of claim 1 wherein:

said circuit board comprises a plurality of electrical contact switches disposed in a semi-circular array for receipt of said first coded sequence of switch activation, said semi-circular array of switches occupying an arc of approximately a first 180 degrees of the circle of rotation of said knob, and said arc of rotation of said knob for shifting of said door bolt occupies the remaining 180 degrees of knob rotation available.

3. The electronic door lock of claim 2 wherein:

said limit means comprises a limit disc having a pair of limit stops on the periphery thereof and a post normally positioned to engage said stops upon rotation of said disc in either of two rotative directions to thereby limit the arc of rotation of said disc to an arc of less than 360 degrees.

4. The electronic door lock of claim 3 wherein:

said first electrically operated means comprises a first solenoid having a body and an armature portion which provides said post.

5. The electronic door lock of claim 4 wherein:

said limit disc has retainer lips associated with said stops, and said post has a retainer flange whereby when said post engages one of said stops, said post flange is retained by an associated retainer lip of said lips against said stop.

6. The electronic door lock of claim 1 wherein:

said lever control means comprises an actuating disc rotatably movable and independent of said door handle manipulation, and having a first actuating finger and an actuating post; and a control disc rotatably movable and dependant with said door handle manipulation, having a second actuating finger and a control key; whereby said control key is normally captured by said locking means and upon release of said control key from capture, manipulation of said door handle enables said second actuating finger to cooperate radially with said actuating post further enabling said first actuating finger to manipulate said second door bolt into the retracted position.

7. The electronic door lock of claim 6 wherein:

said locking means comprises a locking plate, a control aperture, and a pivot guide channel, whereby said control aperture normally captures and restricts said control key and pivoting of said locking plate releases said control key from capture and said locking plate pivot position is controlled by cooperation of said pivot guide channel with said electrically operated means.

8. The electronic door lock of claim 7 wherein:

said second electrically operated means comprises a second solenoid, a linkage associated with said second solenoid, and a pivot pin fixed to the end of said linkage which travels freely within said pivot guide channel, said second solenoid retracting said linkage in response to said second code responsive signal enabling said locking plate to pivot and disengage said control key.

9. The electronic door lock of claim 8 wherein:

said door handle has an associated shaft which penetrates perpendicularly through said door and said actuating and control discs are mounted axially on said shaft.

10. The electronic door lock of claim 1 wherein:

a digital keypad code entry means is provided for entry of said first and second coded sequences whereby said first coded sequence may be entered manually by use of either of said knob means or said digital keypad means and said second coded sequence is only entered manually by use of said digital keypad means.

11. An electronic door lock having a first code entry door bolt mechanism and a second code entry door bolt mechanism, said first code entry door bolt mechanism comprising:

a first door bolt and a knob means for shifting said first door bolt between retracted and protracted positions;

limit means for normally limiting rotation of said knob means and thereby normally restricting operation of said first door bolt;

first electrically operated means for deactivating said limit means to thereby release said knob means for manipulation of said first door bolt to retracted position;

said second code entry door bolt mechanism comprising:

a second door bolt and a biasing spring associated with said second door bolt for maintaining protracting pressure on said second door bolt;

locking means for normally restricting movement of said second door bolt;

second electrically operated means for releasing said locking means to thereby enable retraction of said second door bolt.

12. The electronic door lock of claim 11 wherein:

said first door bolt of said first code entry door bolt mechanism is a deadbolt, whereby rotation of said knob shifts said deadbolt between protracted and retracted positions and said deadbolt is utilized during extended closure periods such as at night; and wherein said second door bolt of said second code entry door bolt mechanism is a cam bolt whereby said cam bolt deflects inwardly of said door on closing of said door relative an associated door jamb and which moves under its spring bias into a bolt receiving receptacle in said door jamb and said cam bolt is utilized during frequent use periods such as during day time.

* * * * *